United States Patent [19]

Seeley et al.

[11] 4,177,468

[45] Dec. 4, 1979

[54] INFLATABLE CAVITY-BACKED ANNULAR SLOT TRANSMITTING ANTENNA

[75] Inventors: Elwin W. Seeley; Verne E. Hildebrand, both of San Diego, Calif.

[73] Assignee: The United States of America as represented by the Secretary of the Navy, Washington, D.C.

[21] Appl. No.: 939,735

[22] Filed: Sep. 5, 1978

[51] Int. Cl.[2] ..... H01Q 1/34; H01Q 13/10

[52] U.S. Cl. ..... 343/710; 343/769

[58] Field of Search ..... 343/709, 710, 769, 789, 343/908

[56] References Cited

U.S. PATENT DOCUMENTS

| | | | |
|---|---|---|---|
| 2,508,085 | 5/1950 | Alford | 343/769 |
| 3,670,247 | 6/1972 | Gutton et al. | 343/709 |

*Primary Examiner*—Eli Lieberman

*Attorney, Agent, or Firm*—R. S. Sciascia; G. J. Rubens; T. M. Phillips

[57] ABSTRACT

A transmitting antenna that can be inflated with air or a liquid dielectric and floated in seawater. It consists of a cuplike cavity backing a radiating annular slot antenna. It can be used to communicate to submarines or surface ships or as a navigation transmitting antenna. It is small compared to the wavelength of the operating frequency.

10 Claims, 3 Drawing Figures

INFLATABLE CAVITY-BACKED ANNULAR SLOT TRANSMITTING ANTENNA

BACKGROUND OF THE INVENTION

Modern concepts for integrated operations between submarine and surface fleet units require significant improvements in communication capability to submerged submarines. The capability to communicate with a submarine in a nuclear environment is operationally most advanced at VLF. The use of ELF would allow communications with submarines operating at greater depths. The flexibility of using these frequencies (ELF/VLF) is greatly restricted by available transmitting antennas, particularly on platforms or at locations with the potential of remaining undetected until the start of transmission.

SUMMARY OF THE INVENTION

The present invention provides for an inflatable cavity-backed annular slot transmitting antenna for radiating low frequency energy. The antenna consists of a cuplike cavity backing a radiating annular slot. The inner and outer walls of the cup are separated by dielectric material which may either be inflatable air bags or filled with a liquid dielectric. The walls of the cup may be either of metalized cloth or copper screening or it may be solid metal.

OBJECTS OF THE INVENTION

Accordingly an object of the invention is the provision of an antenna that can radiate low frequency energy, is small (compared to the operating wavelength), efficient and has a low profile.

Another object of the invention is the provision of an antenna that is capable of being floated in the ocean, is portable, has a low profile for transmitting low frequency energy and has a radiating pattern the same as a large vertical monopole antenna.

Other objects and many of the attendant advantages of this invention will be readily appreciated as the same becomes better understood by reference to the following detailed description when considered in connection with the accompanying drawings.

DESCRIPTION OF THE PREFERRED EMBODIMENTS

Figure 1:
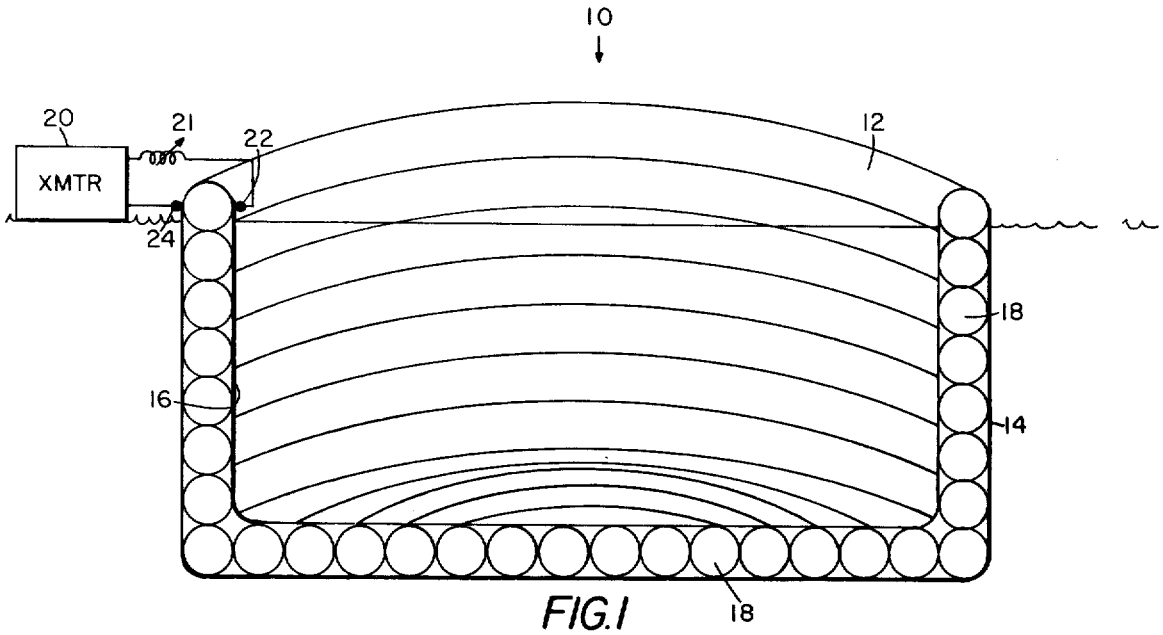
FIG. 1 shows one embodiment of the invention.

Referring now to the drawings wherein there is shown in FIG. 1 a transmitting antenna 10 that can be inflated with air or liquid dielectric and floated in seawater. The antenna consists of a radiating slot 12 and a back-cavity for the circular slot 12 formed essentially in the shape of a cup. The walls 14 and 16 of the cavity are formed by doughnut shaped bags 18 which may be inflated with air or a liquid dielectric. The doughnut shaped bags 18 are held together with metalized cloth making sure that the inner wall is insulated from the outer wall. As can be readily seen the walls 14 and 16 of the cup form the backup cavity for the circular slot 12 formed by the lip of the cup protruding through the water surface. A transmitter 20 feeds energy to the antenna 10 by connecting it through tuning coil 21 to terminal 22 of the metalized cloth forming the inner wall 16 and to the terminal 24 of the outer wall 14. If desired the metalized cloth forming the inner and outer walls 16 and 14, respectively, may be replaced with copper screen.

Figure 2:
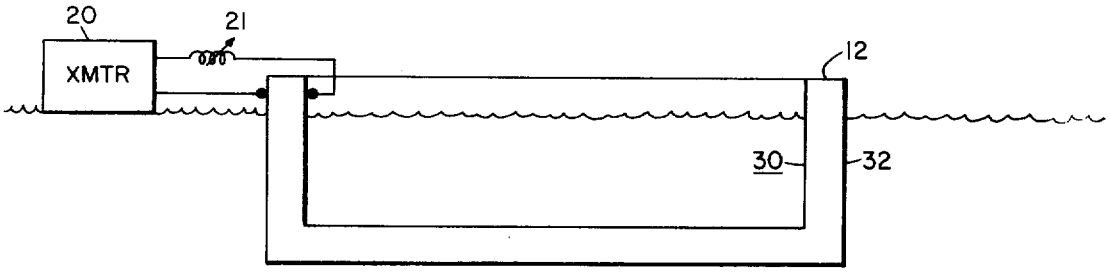
FIG. 2 shows another embodiment of the invention with rigid wall construction.
Figure 3:
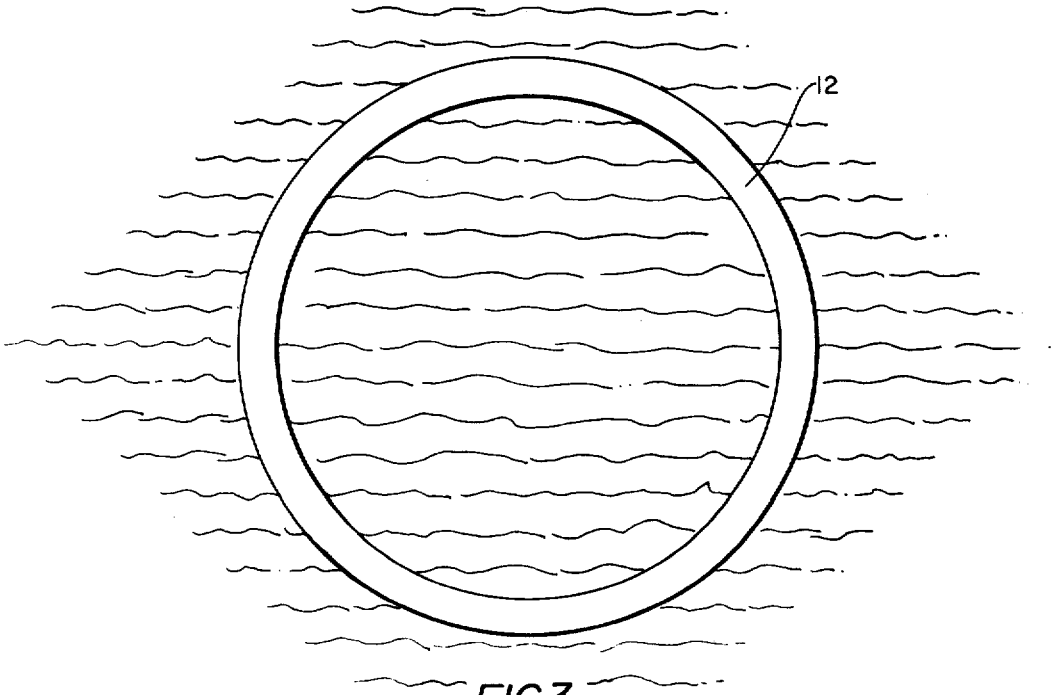
FIG. 3 is a plan view showing the annular radiating slot of the antenna of the embodiments of FIGS. 1 and 2.

In the embodiment shown in FIG. 2, rigid metal walls 30 and 32 are shown in place of the flexible metalized cloth or copper screen walls 14 and 16 of FIG. 1. Rigid walls that were made of either steel or zinc were found to cause the antenna to radiate efficiently.

In operation and with the transmitter operating at 100 kHz, the slot width 12 should be about 4 meters for a 100 meter diameter antenna. With the transmitter 20 operating at 3 kHz and 400 meter diameter antenna the slot width 12 need not be greater than .05 meters. It has been found that transmitter 20 operating at 100 kHz, with tuning coil 21 ($q=3{,}000$), slot width 12 of 1 meter, antenna 10 diameter of 400 meters and with the depth of the cavity at 10 meters, radiation with 75% efficiency was achieved.

Obviously, many other modifications and variations of the present invention are possible in the light of the above teachings. It is therefore to be understood that within the scope of the appended claims the invention may be practiced otherwise than as specifically described.

What is claimed is:

1. A floatable radio antenna capable of floating in a liquid with the radiating slot projecting above the surface, comprising:

a cup shaped body having an inner conducting surface and an outer conducting surface, said inner conducting surface being separated from said outer surface by buoyant insulating means with the lip of the cup shaped body forming the radiating slot.

2. The antenna of claim 1 wherein said buoyant insulating means are doughnut shaped inflated with air.

3. The antenna of claim 1 wherein said buoyant insulating means are doughnut shaped bags inflated with a liquid dielectric.

4. The antenna of claim 2 wherein said conducting means is made of metalized cloth.

5. The antenna of claim 2 wherein said conducting means is made of copper screen.

6. The antenna of claim 2 wherein said conducting surfaces are rigid and made of metal.

7. The antenna of claim 2 further comprising a source of low frequency energy to be radiated being connected between said inner and outer surfaces.

8. The antenna of claim 3 further comprising a source of low frequency energy to be radiated being connected between said inner and outer surfaces.

9. The antenna of claim 1 wherein said cup shaped body is filled with seawater.

10. The antenna of claim 6 wherein said cup shaped body is filled with seawater.

* * * * *